US010926388B2

(12) United States Patent
Schmidt et al.

(10) Patent No.: US 10,926,388 B2
(45) Date of Patent: Feb. 23, 2021

(54) FUEL-POWERED SETTING DEVICE AND METHOD FOR OPERATING SUCH A SETTING DEVICE

(71) Applicant: Hilti Aktiengesellschaft, Schaan (LI)

(72) Inventors: Dominik Schmidt, Buchs (CH); Norbert Heeb, Buchs (CH); Tilo Dittrich, Feldkirch (AT); Peter Bruggmueller, Bludesch (AT)

(73) Assignee: Hilti Aktiengesellschaft, Schaan (LI)

( * ) Notice: Subject to any disclaimer, the term of this patent is extended or adjusted under 35 U.S.C. 154(b) by 318 days.

(21) Appl. No.: 16/063,806

(22) PCT Filed: Dec. 20, 2016

(86) PCT No.: PCT/EP2016/081860
§ 371 (c)(1),
(2) Date: Jun. 19, 2018

(87) PCT Pub. No.: WO2017/108751
PCT Pub. Date: Jun. 29, 2017

(65) Prior Publication Data

US 2020/0262041 A1 Aug. 20, 2020

(30) Foreign Application Priority Data

Dec. 22, 2015 (EP) ..... 15201871

(51) Int. Cl.
*B25C 1/08* (2006.01)

(52) U.S. Cl.
CPC ..... *B25C 1/08* (2013.01)

(58) Field of Classification Search
CPC ..... B25C 1/04; B25C 1/08; B25C 1/12
(Continued)

(56) References Cited

U.S. PATENT DOCUMENTS 4,773,581 A 9/1988 Ohtsu et al.
6,755,159 B1 * 6/2004 Adams ..... B25C 1/08 123/46 R
(Continued)

FOREIGN PATENT DOCUMENTS

DE 40 10 517 A1 10/1991
DE 42 43 617 A1 6/1994
(Continued)

OTHER PUBLICATIONS

International Bureau, International Search Report in International Application No. PCT/EP2016/081860, dated Apr. 12, 2017.

*Primary Examiner* — Nathaniel C Chukwurah
(74) *Attorney, Agent, or Firm* — Leydig, Voit & Mayer, Ltd.

(57) ABSTRACT

The invention relates to a fuel-powered setting device for driving securing elements into a substrate, comprising at least one main combustion chamber for a fuel, a drive piston that can be driven out of the main combustion chamber in a setting direction by expandable gases, and a prechamber with which an ignition device is associated and in which a pressure acting on the main combustion chamber can build up prior to a fuel-air mixture being ignited in said main combustion chamber. To improve efficiency and/or functionality when driving in securing elements, the setting device can be operated in different energy classes by an energy adjustment.

20 Claims, 9 Drawing Sheets

(58) Field of Classification Search
USPC ..... 227/8, 10, 130; 123/46 SC
See application file for complete search history.

(56) References Cited

U.S. PATENT DOCUMENTS

| | | | | |
|---|---|---|---|---|
| 2004/0079302 | A1* | 4/2004 | Wolf | B25C 1/08 123/46 R |
| 2004/0144357 | A1 | 7/2004 | Adams | |
| 2004/0182336 | A1 | 9/2004 | Ohmori et al. | |
| 2005/0035171 | A1 | 2/2005 | Ohtsu et al. | |
| 2005/0229598 | A1 | 10/2005 | Akiba et al. | |
| 2007/0000458 | A1 | 1/2007 | Neumann et al. | |
| 2008/0169326 | A1* | 7/2008 | Moeller | F01L 7/04 227/10 |
| 2010/0187280 | A1 | 7/2010 | Akiba et al. | |
| 2012/0153002 | A1 | 6/2012 | Dittrich | |
| 2016/0144497 | A1 | 5/2016 | Boehm et al. | |

FOREIGN PATENT DOCUMENTS

| | | | |
|---|---|---|---|
| DE | 102 32 035 | A1 | 1/2004 |
| EP | 1 388 394 | A1 | 2/2004 |
| EP | 1 712 334 | A1 | 10/2006 |
| EP | 2 050 542 | A1 | 4/2009 |
| EP | 2 465 643 | A2 | 6/2012 |
| EP | 2826601 | A1 | 1/2015 |
| TW | 200426002 | A | 12/2004 |
| TW | 200524714 | A | 8/2005 |
| TW | 200603961 | A | 2/2006 |
| TW | 200823019 | A | 6/2008 |
| TW | 201026455 | A | 7/2010 |
| TW | 201119805 | A | 6/2011 |
| WO | WO 2008/029687 | A1 | 3/2008 |
| WO | WO 2008/118838 | A1 | 10/2008 |
| WO | WO 2009/014862 | A1 | 1/2009 |
| WO | WO 2011/028721 | A1 | 3/2011 |
| WO | WO 2017/108745 | A1 | 6/2017 |
| WO | WO 2017/108777 | A1 | 6/2017 |
| WO | WO 2017/108786 | A1 | 6/2017 |

* cited by examiner

FUEL-POWERED SETTING DEVICE AND METHOD FOR OPERATING SUCH A SETTING DEVICE

CROSS-REFERENCE TO RELATED APPLICATIONS

This patent application is the U.S. National Stage of International Patent Application No. PCT/EP2016/081860, filed Dec. 20, 2016, which claims the benefit of European Patent Application No. 15201871.9, filed Dec. 22, 2015, which are each incorporated by reference.

TECHNICAL AREA

The invention relates to a fuel-powered setting device for driving securing elements into a substrate, comprising at least one combustion chamber for a fuel, a drive piston that can be driven out of the main combustion chamber in a setting direction by means of expandable gases, and a pre-chamber with which an ignition device is associated and in which a pressure acting on the main combustion chamber can be built up prior to a fuel-air mixture being ignited in said main combustion chamber. The invention furthermore relates to a method for operating such a setting device.

BACKGROUND OF THE INVENTION

A fuel-powered setting device for driving securing elements into a substrate is known from German published application DE 10 32 035 A1, comprising at least one main combustion chamber for a fuel, a drive piston mounted in a piston guide, which can be driven out of the main combustion chamber in a setting direction by means of expandable gases, and a pre-chamber in which a pressure acting on the main combustion chamber can be built up prior to a fuel-air mixture being ignited in said main combustion chamber, wherein the pre-chamber is formed on an underside, facing away from the main combustion chamber, of the space inside the piston guide adjoining the drive piston located in its starting position, and wherein the pre-chamber is at least sometimes connected via a passage to the main combustion chamber, wherein a means for detecting the pressure is provided in the main combustion chamber, which means interacts with the ignition device for the main combustion chamber. A portable, fuel-powered working device is known from German published application DE 42 43 36 17 A1, in particular a setting device for securing elements, comprising an in particular cylindrical combustion chamber for combusting an air-fuel mixture, whereby a tappet is drivable via a piston guided by the combustion chamber cylinder, wherein a pre-chamber connected to a lower face of the piston facing away from the combustion chamber is provided, in which pre-chamber an ignition-induced combustion process of an air-fuel mixture can be triggered for the in particular essentially isentropic compression of the air-fuel mixture in the combustion chamber.

BRIEF SUMMARY OF THE INVENTION

The object of the invention is to improve the effectiveness and/or the functionality during the driving of securing elements using a fuel-powered setting device, comprising at least one main combustion chamber for a fuel, a drive piston that can be driven out of the main combustion chamber in a setting direction by means of expandable gases, and a pre-chamber with which an ignition device is associated and in which a pressure acting on the main combustion chamber can be built up prior to a fuel-air mixture being ignited in said main combustion chamber.

The object is achieved in a fuel-powered setting device for driving securing elements into a substrate, comprising at least one combustion chamber for a fuel, a drive piston that can be driven out of the main combustion chamber in a setting direction by means of expandable gases, and a pre-chamber with which an ignition device is associated and in which a pressure acting on the main combustion chamber can be built up prior to a fuel-air mixture being ignited in said main combustion chamber, in that the setting device can be operated in different energy classes by means of an energy adjustment. The area of application of a setting device having pre-combustion is thus significantly expanded.

One preferred exemplary embodiment of the fuel-powered setting device is characterized in that the pre-chamber is connected or connectable to an environment of the pre-chamber by means of at least one passage opening, which is closable by a control device, wherein a flow cross section of the passage opening is adjustable for the energy adjustment. Energy can advantageously be effectively dissipated in the form of flow losses by the adjustability of the flow cross section of the passage opening. In addition, undesired energy loss during an approach of the drive piston to a gas cushion in the pre-chamber can be significantly reduced by the adjustability of the flow cross section of the passage opening. The adjustability of the flow cross section of the passage opening advantageously provides the advantage in this case that otherwise large changes do not have to be performed on the setting device. The change of the flow cross section of the passage opening of the pre-chamber can be performed by a user either mechanically or electromechanically.

A further preferred exemplary embodiment of the fuel-powered setting device is characterized in that the control device for the energy adjustment has a positioning sleeve having at least one positioning opening, which can be lined up more or less with the passage opening, in order to change the flow cross section of the passage opening. The positioning opening preferably has the same form and the same size as the passage opening. In the case of complete overlap between the setting opening and the passage opening, the effective flow cross section is maximal. The effective flow cross section can be continuously adjusted, in particular reduced down to zero, by a movement of the positioning sleeve in relation to the passage opening of the pre-chamber. A particularly convenient energy adjustment is thus enabled.

A further preferred exemplary embodiment of the fuel-powered setting device is characterized in that the positioning sleeve for the energy adjustment is guided so it is movable in relation to a pre-chamber cylinder, which has the passage opening. The passage opening and the setting opening preferably essentially have the form of circular holes. The effective flow cross section can be continuously adjusted by movement of the setting sleeve in relation to the pre-chamber cylinder, in particular by a rotation or longitudinal movement of the positioning sleeve in relation to the pre-chamber cylinder.

A further preferred exemplary embodiment of the fuel-powered setting device is characterized in that the positioning sleeve is movable in an electromotive manner. An electromotive setting drive for the positioning sleeve comprises, for example, an electric motor. The electric motor is advantageously fastened on the pre-chamber cylinder. A gearwheel, for example, which is driven by means of a shaft of the electric motor, is used for the force transmission from the electric motor to the positioning sleeve. The gearwheel is advantageously engaged with gear teeth, in particular with gear teeth extending in the circumferential direction, on the positioning sleeve.

A further preferred exemplary embodiment of the fuel-powered setting device is characterized in that the positioning sleeve for the energy adjustment is combined with a control sleeve, which is embodied and movable in relation to the passage opening of the pre-chamber such that the passage opening of the pre-chamber is released or closed by the control sleeve depending on the main combustion chamber pressure. The control sleeve has, for example, essentially the form of a right circular cylinder jacket, which is movable in relation to a housing or a cylinder, which delimits the pre-chamber, between an open position, in which the passage opening of the pre-chamber is released or open, and a closed position, in which the passage opening of the pre-chamber is released.

A further preferred exemplary embodiment of the fuel-powered setting device is characterized in that the control device has at least one control pressure surface, to which the main combustion chamber pressure is applied and which is mechanically coupled to a control sleeve, which is movable back and forth and the maximum stroke of which can be varied for the energy adjustment. The movement of the control sleeve is advantageously controlled by means of the main combustion chamber pressure, which acts on the control pressure surface. The movement of the control sleeve between the open position and the closed position is enabled, for example, by a guide of the control sleeve on the housing or the cylinder, respectively, which delimits the pre-chamber. An adjustment of the flow cross section for venting the pre-chamber is enabled in a simple manner by the variation of the maximum adjustment stroke of the control sleeve.

A further preferred exemplary embodiment of the fuel-powered setting device is characterized in that the control device has at least one control pressure surface, to which the main combustion chamber pressure is applied and which is mechanically coupled to a control sleeve, which is embodied and movable in relation to the passage opening of the pre-chamber such that the passage opening of the pre-chamber is released or closed more or less by the control sleeve depending on the main combustion chamber, wherein the control pressure surface is mechanically coupled via a coupling element to the control sleeve, wherein the control pressure surface is supported via at least one spring device on a stop, which is adjustable for the energy adjustment, to adjust a pre-tension force of the spring device. By means of a reduction of the spring pre-tension of the control sleeve, in the case of a low main combustion chamber pressure, opening of the passage opening, i.e., venting of the pre-chamber, will take place earlier. The energy can thus be adjusted particularly advantageously in a simple manner. The adjustment of the spring pre-tension of the control sleeve is enabled, for example, by a thread between the pre-chamber cylinder and the stop.

A further preferred exemplary embodiment of the fuel-powered setting device is characterized in that the flow cross section of at least one overflow opening between the pre-chamber and the main combustion chamber is variable for the energy adjustment. The flow cross section of the overflow opening can be varied or changed, respectively, for example, with the aid of a valve device. A support pressure in the main combustion chamber also changes due to the change of the flow cross section of the overflow opening. In this exemplary embodiment, it is possibly advantageous to associate a further ignition device with the main combustion chamber.

The invention furthermore relates to a method for operating an above-described fuel-powered setting device.

One preferred exemplary embodiment of the method is characterized in that the flow cross section of the passage opening is mechanically set by a user of the setting device for the energy adjustment. For this purpose, a corresponding positioning device can be provided on the setting device. The positioning device can be embodied, for example, as a positioning wheel, which can be manually rotated for the energy adjustment.

A further preferred exemplary embodiment of the method is characterized in that the flow cross section of the passage opening is electrically set by means of at least one operating element, which is connected to a or the control device, for the energy adjustment. The operating element can be embodied, for example, as a positioning wheel, which is rotatably attached to the setting device. The above-described electromotive positioning drive for the positioning sleeve, for example, can be used for the electrical adjustment of the flow cross section of the passage opening.

A further preferred exemplary embodiment of the method is characterized in that the flow cross section of the passage opening is set by turning on/off and/or regulating at least one valve device for the energy adjustment. In this case, this is advantageously an electromechanical valve device. The valve device for the energy adjustment is associated, for example, with an overflow opening between the pre-chamber and the main combustion chamber.

A further preferred exemplary embodiment of the method is characterized in that an opening mechanism of the control sleeve is manually set for the energy adjustment. The control sleeve is coupled, for example, via a gearing device to an operating element, in particular a positioning wheel, externally on the setting device.

A further preferred exemplary embodiment of the method is characterized in that an effective size of the control pressure surface of the control device is changed. An adjustment of the control sleeve of the control device can thus be varied in a simple manner.

The invention possibly also relates to a computer program product comprising program code for carrying out an above-described method, in particular when the program is executed in the controller of the setting device.

The invention furthermore relates to a control device, a positioning sleeve, a pre-chamber cylinder, a control sleeve, and/or a valve device for an above-described fuel-powered setting device. The mentioned parts can be handled separately.

BRIEF DESCRIPTION OF THE SEVERAL VIEWS OF THE DRAWINGS

Further advantages, features, and details of the invention result from the following description, in which various exemplary embodiments are described in detail with reference to the drawings. In the figures.

DETAILED DESCRIPTION OF THE INVENTION

Figure 1:
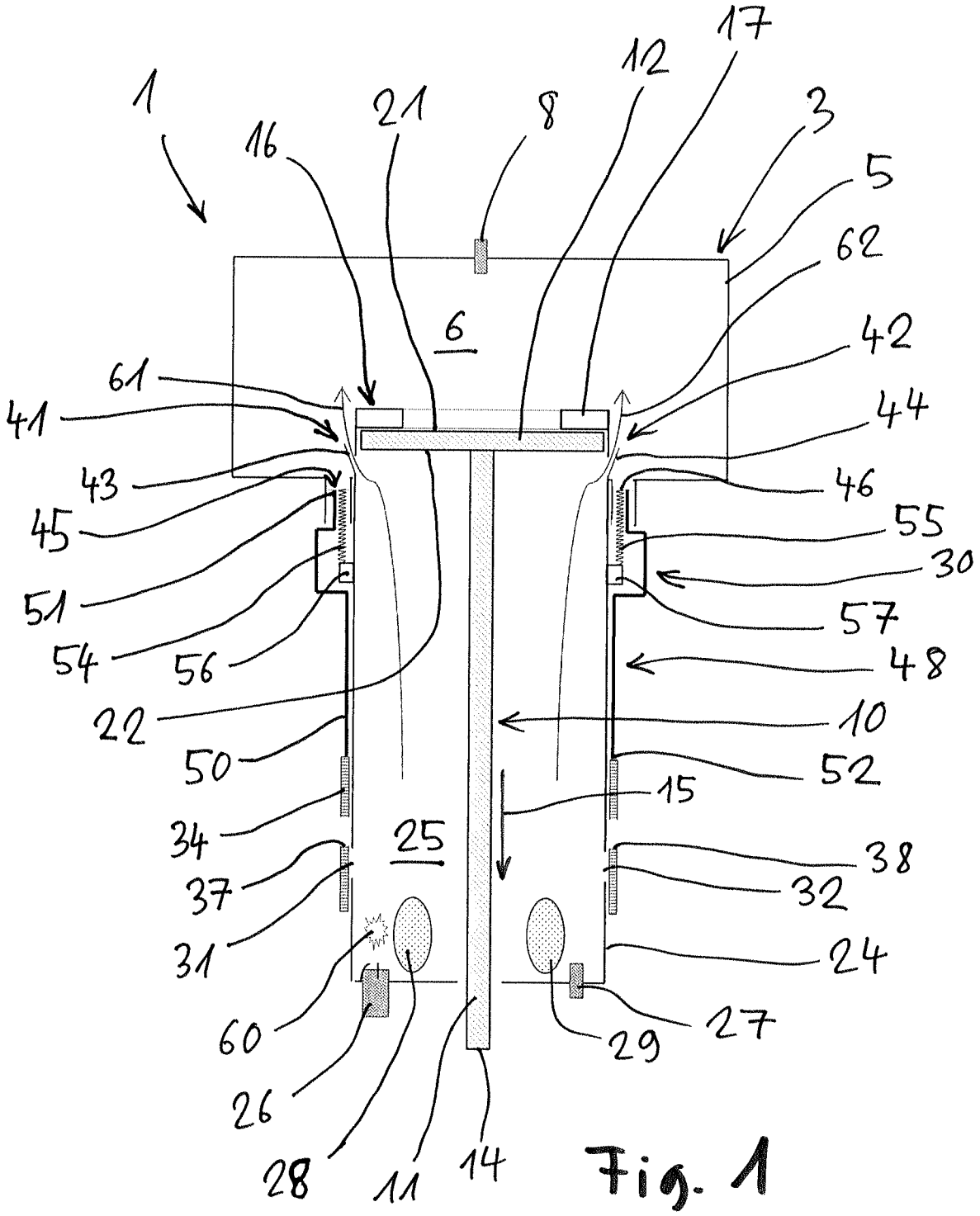
FIG. 1 shows a fuel-powered setting device in longitudinal section, comprising at least one control pressure surface, which is supported by a spring device on a stop, which is adjustable in relation to a pre-chamber cylinder for the energy adjustment.

A setting device 1 is illustrated greatly simplified in a longitudinal section according to various exemplary embodiments and in various operating states in FIGS. 1 to 6. The setting device 1 shown in FIGS. 1 to 6 can be operated using a combustion gas or using a liquid fuel which can be vaporized. The setting device 1 comprises a housing 3 comprising a main cylinder 5, which delimits a main combustion chamber 6. Gas and/or air can be supplied to the main combustion chamber 6 via an inlet device 8. In exemplary embodiments which are not shown, a turbulence generator, in particular a fan wheel driven by a fan motor, is located in the main combustion chamber.

A drive piston 10 is movable back and forth in the housing 3 of the setting device 1 downward and upward in FIGS. 1 to 6. The drive piston 10 comprises a piston rod 11, which originates from a piston head 12. A setting end 14 of the piston rod 11 facing away from the piston head 12 is arranged in a bolt guide (not shown), which is used for guiding securing elements, which are also referred to as bolts. The setting end 14 of the piston rod 11 of the drive piston 10 is shown cutaway in FIG. 6.

The bolt guide having the piston rod 11 of the drive piston 10 arranged therein is also referred to as a setting mechanism. A securing element, such as a nail, bolt, or the like can be driven into a substrate (not shown) via the setting mechanism. Before the setting of a securing element, the setting device 1 is pressed with its bolt guide against the substrate and triggered. A switch (not shown), which is also referred to as a trigger switch, is used, for example, for triggering a setting procedure. The switch is provided, for example, on a handle (also not shown) of the setting device 1.

A setting direction is indicated in FIGS. 1 to 6 by an arrow 15. During the setting of a securing element, the drive piston 10 is strongly accelerated using the piston rod 11 in the setting direction 15, to drive the securing element into the substrate. During the setting procedure, the drive piston 10 is moved from its starting position shown in FIGS. 1 to 5, which corresponds to a top dead center, into an end position, which corresponds to a bottom dead center.

A movement of the drive piston 10 upward in FIGS. 1 to 6 is delimited by a cylinder-fixed piston stop 16. The top dead center of the drive piston 10 is defined by the piston stop 16. The piston stop 16 can be combined with a magnet device 17. The magnet device 17 is used, for example, to hold the drive piston 10 with a predetermined holding force in its starting position shown in FIGS. 1 to 5.

A movement of the drive piston 10 downward is delimited by stop and/or damping elements 28, 29. The stop and/or damping elements 28 are embodied, for example, as cushions.

The piston head 12 comprises a first piston surface 21, which faces toward the main combustion chamber 6. A second piston surface 22, which faces away from the main combustion chamber 6, delimits a pre-chamber 25 in a pre-chamber cylinder 24. The pre-chamber cylinder 24 is, for example, part of the housing 3 of the setting device 1.

The pre-chamber 25 represents a pre-combustion chamber, with which an ignition device 26 and an inlet device 27 are associated. In addition, the stop and/or damping elements 28, 29 are arranged in the pre-chamber 25. The pre-chamber or pre-combustion chamber 25 is supplied with air or a fuel-air mixture via the inlet device 27, which is ignited with the aid of the ignition device 26 in the pre-chamber 25, as indicated by a symbol 60 in FIGS. 1 to 3.

The pre-chamber cylinder 24 comprises two passage openings 31, 32, which enable the exit of exhaust gases from the pre-chamber 25, for example. The passage openings 31, 32 are closable as needed by a control device 30. The control device 30 comprises a control sleeve 34, which has two or more passage openings 37, 38.

Figure 2:
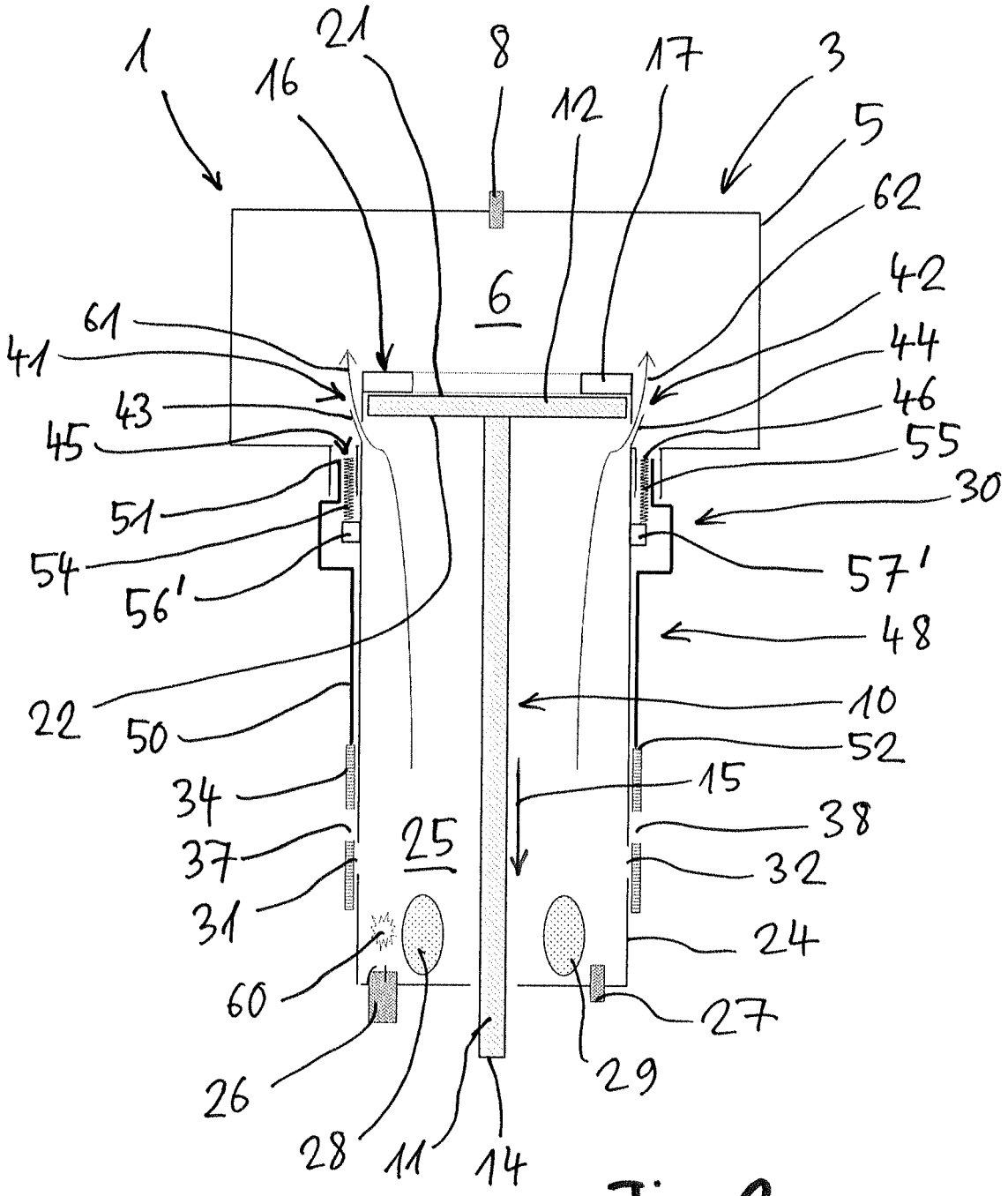
FIG. 2 shows the setting device from FIG. 1 having adjusted stops in longitudinal section.
Figure 3:
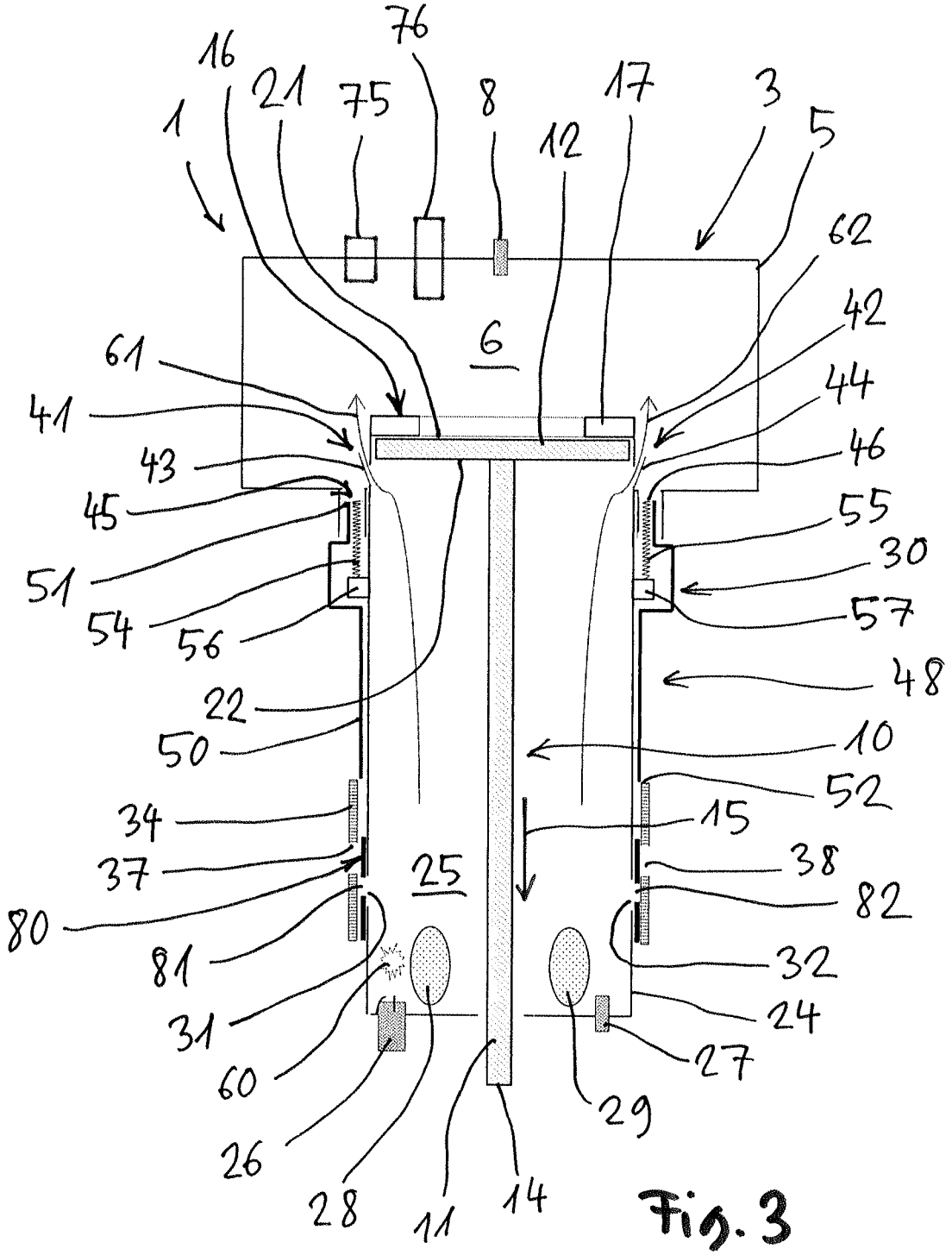
FIG. 3 shows a similar setting device as in FIG. 1 in longitudinal section comprising a positioning sleeve for the energy adjustment shortly after an ignition in a pre-chamber.
Figure 4:
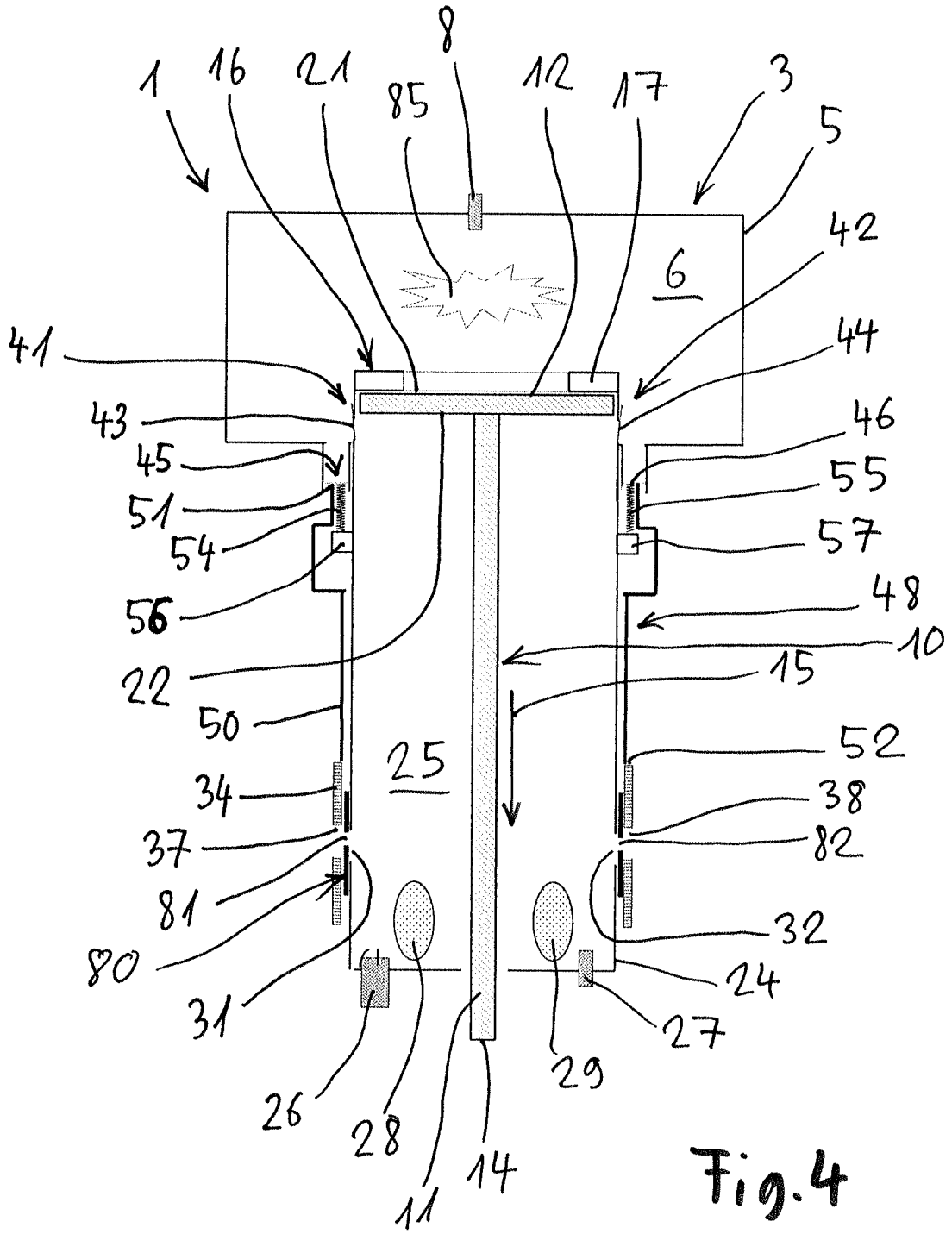
FIG. 4 shows the setting device from FIG. 3 with open passage openings, wherein the positioning sleeve enables operation with less energy shortly after an ignition in a main chamber.
Figure 5:
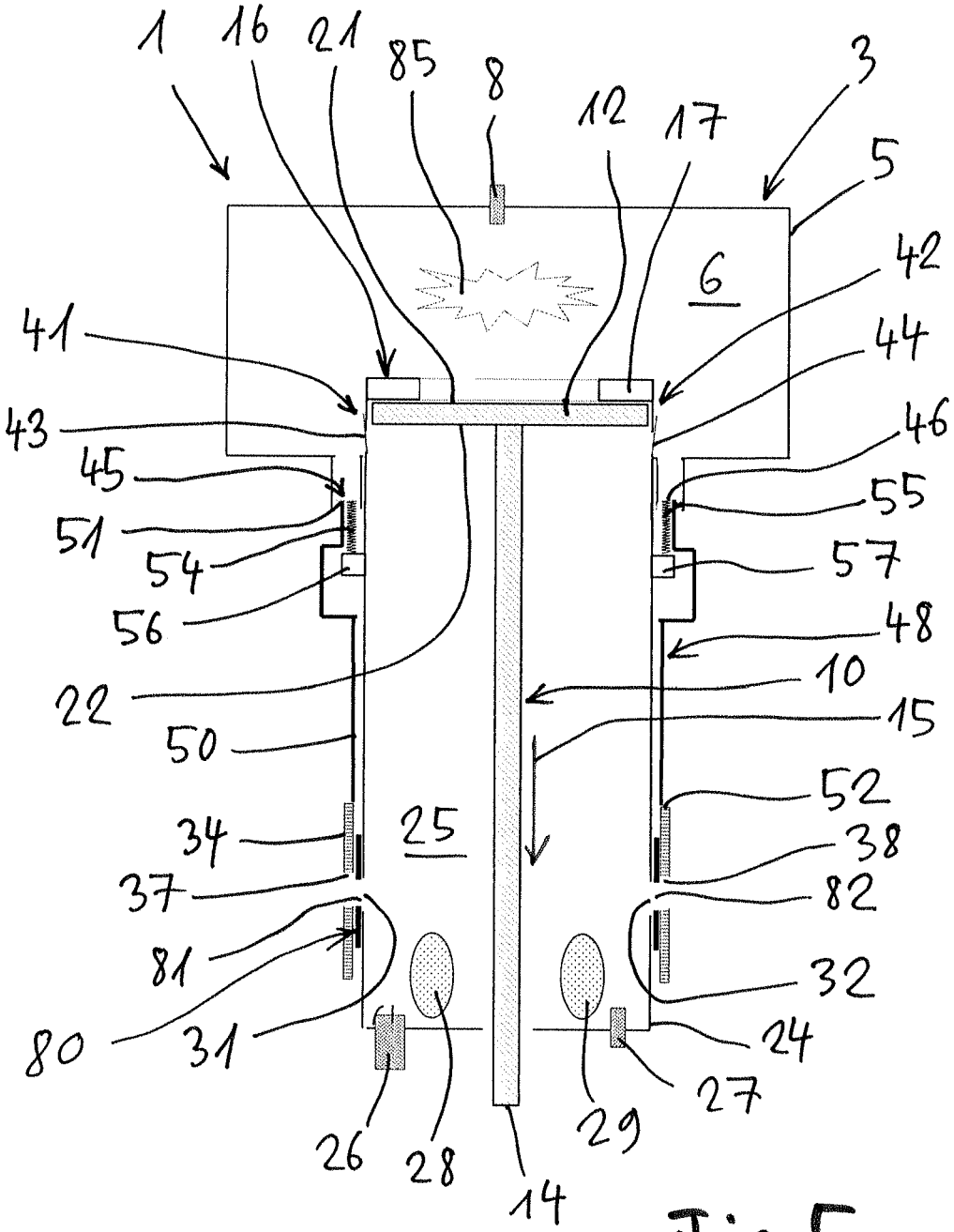
FIG. 5 shows the setting device from FIG. 4, wherein the positioning sleeve enables operation with higher energy shortly after the ignition in a main chamber.

When the passage openings 37, 38 of the control sleeve 34 are brought into line with the passage openings 31, 32, the passage openings 31, 32 are then open, as can be seen in FIGS. 4 and 5. In FIGS. 1 to 3, the passage openings 31, 32 are closed by the control sleeve 34. The control sleeve 34 essentially has the form of a right cylindrical jacket, in particular a circular cylindrical jacket, and is movable downward and upward in FIGS. 1 to 6.

One or more overflow openings 41, 42 are provided between the pre-chamber 25 and the main combustion chamber 6. One valve device 43, 44 is associated with each of the overflow openings 41, 42. The valve devices 43, 44 are, for example, valve flaps, which are open in FIGS. 1 to 3, to enable a passage of the ignited air-fuel mixture from the pre-chamber 25 into the main combustion chamber 6. The valve devices 43, 44 are closed in FIGS. 4 and 5.

The control device 30 comprises a control pressure surface 45, which is connected with respect to the control pressure to the main combustion chamber 6. The control pressure surface 45 is embodied as a ring surface 46, which faces toward the main combustion chamber 6 radially outside the pre-chamber cylinder 24. The control pressure surface 45 is mechanically coupled to the control sleeve 34 via a coupling element 48.

The coupling element 48 is embodied as a slide 50, which is guided so it is movable back and forth on the pre-chamber cylinder 24 downward and upward in FIGS. 1 to 6. The control pressure surface 45, which is embodied as a ring surface 46, is provided on an upper end 51 of the slide 50 in FIGS. 1 to 6. The control sleeve 34 is fastened on a lower end 52 of the slide 50 in FIGS. 1 to 6.

The control device 30 furthermore comprises spring devices 54, 55, which are embodied, for example, as coiled compression springs. A stop 56, 57 is associated with each of the lower ends of the spring devices 54, 55 in FIGS. 1 to 6. The stops 56, 57 are provided on the pre-chamber cylinder 24. The stops 56, 57 are embodied fixed on the cylinder in FIGS. 3 to 6.

The spring devices 54, 55 are clamped between the stops 56, 57 and the upper end 51 of the slide 50 comprising the control pressure surface 45. The slide 50 is thus supported via the spring devices 54, 55 on the stops 56, 57.

FIGS. 1 to 3 show the setting device 1 shortly after the ignition 60 in the pre-chamber 25. It is indicated by the arrows 61, 62 that the ignited mixture enters the main combustion chamber 6 by means of the open valve devices 43, 44 through the overflow openings 41, 42. The passage openings 31, 32 of the pre-chamber 25 are closed by the control sleeve 34.

In operation of the setting device 1 shown in FIGS. 1 to 6, the main combustion chamber 6 is opened, for example, via flushing openings (not shown) to flush the main combustion chamber 6 in a non-pressed-on state of the setting device 1. During the flushing, for example, ambient air is blown through the main combustion chamber 6 with the aid of a ventilator (not shown). The flushing openings (not shown) required for this purpose are closed by pressing the setting device against a substrate. The flushing of the main combustion chamber 6 is used to blow out combustion gases of a prior setting and/or to cool the setting device by means of convection.

Before an ignition by the ignition device 26 in the pre-chamber 25, combustion gas is injected into the pre-chamber 25 and into the main combustion chamber 6 by means of the inlet devices 8 and 27. An ignitable gas-air mixture is thus formed. During an ignition, the ignitable gas-air mixture enclosing the ignition device 26 of the pre-chamber 25 is ignited. During the ignition, a flame front arises, which travels through the pre-chamber 25 and presses, by means of the arising combustion pressure, a part of the mixture through the overflow openings 41, 42 past the open valve devices 43, 44 into the main combustion chamber 6, as indicated by arrows 61, 62 in FIGS. 1 and 2. The ignition in the pre-chamber 25 is indicated by a symbol 60.

The passage openings 31, 32 of the pre-chamber 25 are closed by the control sleeve 34. A laminar flame front forms in the closed system, which is accelerated by the rising pressure, and partially conveys the spatially leading mixture into the main combustion chamber 6. The flame front in the pre-chamber 25 generates an elevated pressure in the main combustion chamber 6. The flames strike through the valve devices 43, 44 and/or the overflow openings 41, 42 and ignite the mixture in the main combustion chamber 6. The valve devices 43, 44 can be embodied as simple boreholes having spring-loaded flaps.

The combustion of the mixture in the main combustion chamber 6 results in a high pressure increase, which has the consequence that the valve devices 43, 44 close. The high pressure in the main combustion chamber 6 acts by means of the control pressure surface 45 on the spring device 54, 55. The pressure acts on the control sleeve 34 by means of the coupling element 48, and therefore the passage openings 31, 32 of the pre-chamber 25 are released and enable an escape of the exhaust gases during a movement of the drive piston 10 comprising the piston head 12, which is also referred to as a pressure plate, downward.

The setting device 1 is shown shortly after the ignition 60 of the pre-chamber 25 in FIG. 1. The spring devices 54, 55 are relatively slightly pre-tensioned. The stops 56, 57 of the spring devices 54, 55 are embodied fixed on the cylinder in the setting device 1 shown in FIGS. 3 to 6. In the setting device 1 shown in FIGS. 1 and 2, the stops 56, 57 are movable parallel to the setting direction 15, i.e., downward and upward in FIGS. 1 and 2.

The mobility of the stops 56, 57 in relation to the pre-chamber cylinder 24 is achieved in a simple manner by a thread. The thread comprises, for example, an external thread on the pre-chamber cylinder 24 in the region of the stops 56, 57. The stops 56, 57 are formed, for example, on a ring body, which has an internal thread on the radial inside, which meshes with the external thread on the pre-chamber cylinder 24.

The stops 56', 57' are arranged farther upward in FIG. 2 in comparison to FIG. 1. The spring devices 54, 55 are thus pre-tensioned more strongly than in FIG. 1. With reduced spring pre-tension, as shown in FIG. 1, venting of the pre-chamber 25 will take place earlier at a lower main combustion chamber pressure. An energy adjustment can thus be carried out in a simple manner via the adjustable stops 56, 57.

Figure 6:
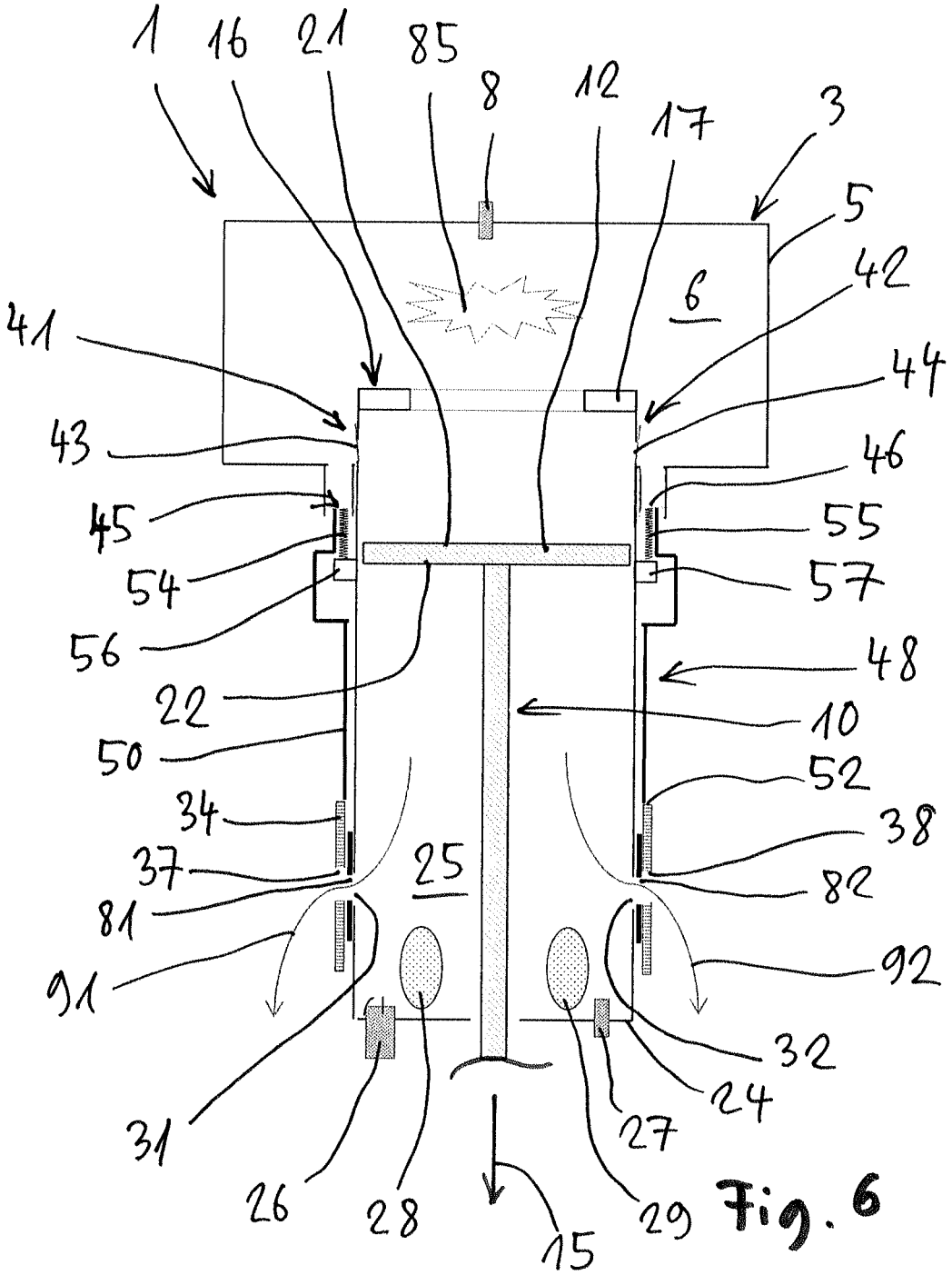
FIG. 6 shows the setting device from FIGS. 3 to 5, wherein a drive piston has moved with high energy in the setting direction.

A valve device, which is used, for example, for venting the main combustion chamber 6, is indicated by a rectangle 75 in FIG. 3. A further ignition device, which is associated with the main combustion chamber 6, is indicated by a rectangle 76. Further operating modes of the setting device 1 are enabled by the further ignition device 76. In FIGS. 4 to 6, however, it can be seen that the setting device 1 can also be operated only using the ignition device 26 of the pre-chamber 25, i.e., without the further ignition device 76 of the main combustion chamber 6.

The setting device 1 shown in FIGS. 3 to 6 comprises a positioning sleeve 80 having positioning openings 81, 82 for the energy adjustment. The positioning openings 81, 82 are used for adjusting an effective flow cross section through the passage openings 31, 32 of the pre-chamber 25.

The setting device 1 shown in FIG. 3 corresponds, except for the positioning sleeve 80, to the setting device 1 in FIG. 1. The setting device 1 is shown shortly after the ignition 60 of the pre-chamber 25. The passage openings 31, 32 of the pre-chamber 25 are closed by the control sleeve 34.

It is indicated by a symbol 85 in FIG. 4 that the ignition of the main combustion chamber 6, which is also referred to in short as the main chamber, has occurred. The ignition of the gas mixture in the main combustion chamber 6 has been triggered by the progressing flame front from the pre-chamber 25. The pressure generated by the ignition 85 of the main combustion chamber 6 acts via the control pressure surface 45 on the spring devices 54, 55, whereby they are compressed. At the same time, the movement of the control surface 45 downward is transferred via the coupling element 48 to the control sleeve 34, which results in an opening of the passage openings 31, 32 of the pre-chamber 25 by the control sleeve 34. The positioning sleeve 80 is set such that the effective flow cross section is reduced, which corresponds to a position for setting using low energy.

In FIG. 5, in contrast to FIG. 4, the positioning sleeve 80 is adjusted such that the effective flow cross section through the passage openings 31, 32 is maximal. Setting using high energy is thus enabled.

The setting device 1 is shown somewhat later after the ignition 85 in the main combustion chamber 6 in FIG. 6. The effective flow cross section through the passage openings 31, 32 is maximal, as in FIG. 5. Setting thus takes place using high energy. It is indicated by arrows 91, 92 that the drive piston 10 comprising the piston head 12 moves downward at high velocity in the setting direction 15. In this case, as indicated by the arrows 91, 92 in FIG. 6, combustion gases can escape from the pre-chamber 25 through the passage openings 31, 32, and therefore the movement of the drive piston 10 is not braked by a counter pressure in the pre-chamber 25.

Figure 7:
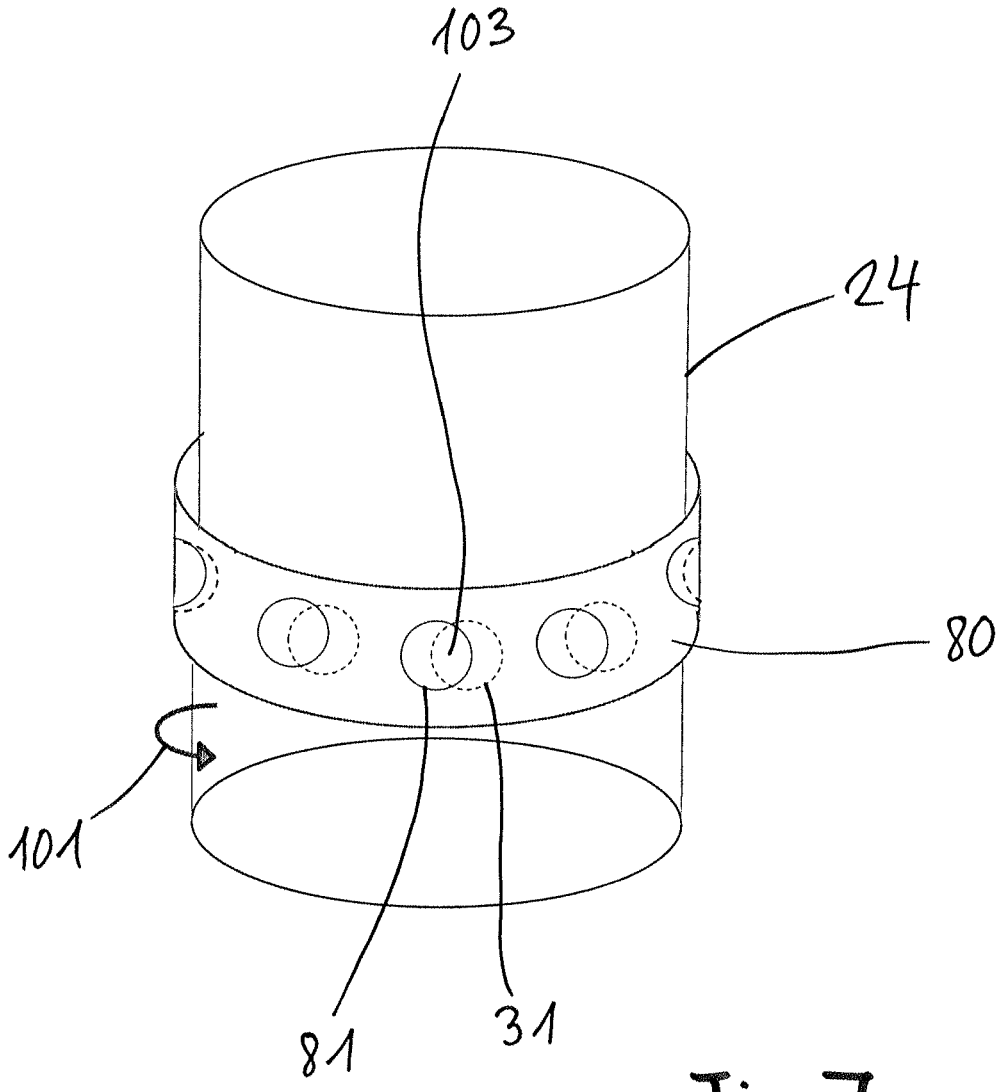
FIG. 7 shows a perspective illustration of the positioning sleeve with a reduced effective flow cross section, to enable an operation with less energy.
Figure 8:
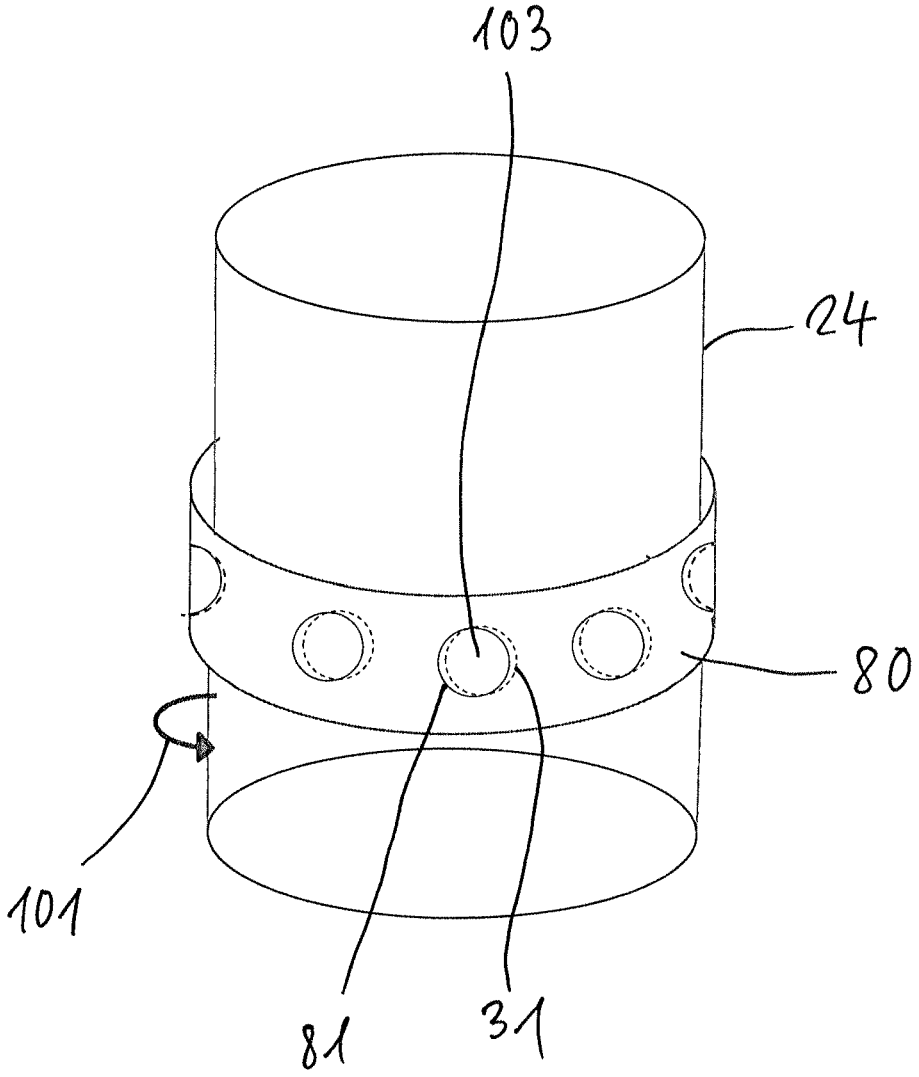
FIG. 8 shows the setting sleeve from FIG. 7 with a maximum effective flow cross section, to enable an operation of the setting device with high energy.

The positioning sleeve 80 is shown in perspective with a section of the pre-chamber cylinder wall 24 in FIGS. 7 and 8. The positioning sleeve 80 essentially has the form of a right circular cylindrical jacket, which, as indicated in FIGS. 7 and 8 by an arrow 101, is pivotable in relation to the pre-chamber cylinder 24. By pivoting the positioning sleeve 80 in relation to the pre-chamber cylinder 24, an effective flow cross section 103 through the passage opening 31 into the pre-chamber cylinder 24 can be varied.

The positioning opening 81 of the positioning sleeve 80 preferably has the same form and size as the passage opening 31 of the pre-chamber cylinder 24. The pre-chamber cylinder 24 comprises one or more passage openings, which are in particular arranged distributed uniformly in the circumferential direction, and which are not provided with reference signs. In the same manner, the positioning sleeve 80 has positioning openings arranged uniformly distributed in the circumferential direction, which are also not provided with reference signs.

In FIG. 7, the positioning sleeve 80 comprising the positioning openings 81 is pivoted in relation to the pre-chamber cylinder 24 such that the effective flow cross section through the passage opening 31 of the pre-chamber cylinder 24 is reduced. A position for operation with low energy is thus enabled.

In FIG. 8, the positioning sleeve 80 comprising the positioning openings 81 is pivoted such that a maximum overlap with the passage opening 31 of the pre-chamber cylinder 24 is achieved. The effective flow cross section 103 is thus maximal. Setting with high energy is thus enabled.

Figure 9:
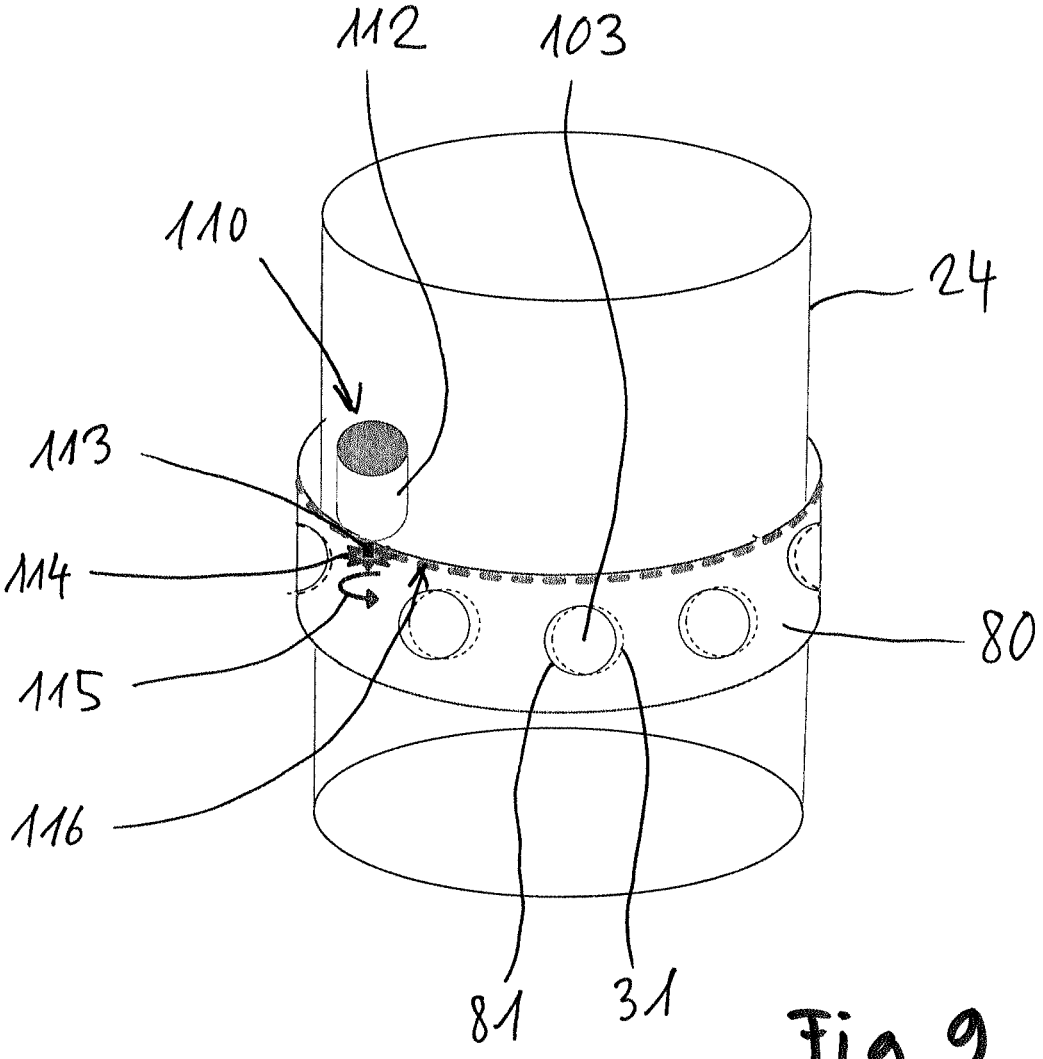
FIG. 9 shows the setting sleeve from FIGS. 7 and 8 comprising an electromotive drive for the energy adjustment.

FIG. 9 shows that the pivoting of the positioning sleeve 80 in relation to the pre-chamber cylinder 24 can be performed by a positioning drive 110 comprising an electric motor 112. The electric motor 112 is fastened on the pre-chamber cylinder 24. The electric motor 112 drives a gearwheel 114 via a shaft 113, as indicated by an arrow 115. The gearwheel 114 meshes with gear teeth 116, which are provided like a toothed rack in a circumferential direction on the top on the positioning sleeve 80.

The invention claimed is:

1. A fuel-powered setting device for driving securing elements into a substrate, comprising at least one main combustion chamber for a fuel; a drive piston that can be driven out of the main combustion chamber in a setting direction by expandable gases; and a pre-chamber with which an ignition device is associated and in which a pressure acting on the main combustion chamber can be built up prior to a fuel-air mixture being ignited in said at least one main combustion chamber; wherein the setting device comprises a control device for energy adjustment.

2. The fuel-powered setting device as claimed in claim 1, wherein the pre-chamber is connected or connectable by at least one passage opening, which is closable by the control device, to an environment of the pre-chamber, wherein a flow cross section of the at least one passage opening is adjustable for the energy adjustment by the control device.

3. The fuel-powered setting device as claimed in claim 2, wherein the control device has a positioning slide or a positioning sleeve comprising at least one positioning opening, which can be brought into line with the at least one passage opening, in order to change the flow cross section of the at least one passage opening.

4. The fuel-powered setting device as claimed in claim 3, further comprising a positioning sleeve for the energy adjustment, wherein the positioning sleeve is guided so it is movable in relation to a pre-chamber cylinder, which has the at least one passage opening.

5. The fuel-powered setting device as claimed in claim 4, wherein the positioning sleeve is movable in an electromotive manner.

6. The fuel-powered setting device as claimed in claim 5, wherein the positioning sleeve for the energy adjustment is combined with a control sleeve, which is movable in relation to the at least one passage opening of the pre-chamber such that the at least one passage opening of the pre-chamber is released or closed by the control sleeve depending on the pressure in the at least one main combustion chamber.

7. The fuel-powered setting device as claimed in claim 2, wherein the control device has at least one control pressure surface, to which the pressure in the at least one main combustion chamber is applied and which is mechanically coupled to a control sleeve, which is movable back and forth, and the control sleeve has a maximum stroke which can be varied for the energy adjustment.

8. The fuel-powered setting device as claimed in claim 2, wherein the control device has at least one control pressure surface, to which the pressure in the at least one main combustion chamber is applied, and which is mechanically coupled to a control sleeve, which is movable in relation to the at least one passage opening of the pre-chamber such that the at least one passage opening of the pre-chamber is released or closed by the control sleeve depending on the pressure in the at least one main combustion chamber, wherein the control pressure surface is mechanically coupled by a coupling element to the control sleeve, wherein the control pressure surface is supported by at least one spring device on a stop, which is adjustable for the energy adjustment in order to adjust a pre-tension force of the spring device.

9. The fuel-powered setting device as claimed in claim 3, wherein the positioning sleeve for the energy adjustment is combined with a control sleeve, which is movable in relation to the at least one passage opening of the pre-chamber such that the at least one passage opening of the pre-chamber is released or closed by the control sleeve depending on the pressure in the at least one main combustion chamber.

10. The fuel-powered setting device as claimed in claim 3, wherein the positioning sleeve is movable in an electromotive manner.

11. The fuel-powered setting device as claimed in claim 10, wherein the positioning sleeve for the energy adjustment is combined with a control sleeve, which is movable in relation to the at least one passage opening of the pre-chamber such that the at least one passage opening of the pre-chamber is released or closed by the control sleeve depending on the pressure in the at least one main combustion chamber.

12. The fuel-powered setting device as claimed in claim 4, wherein the positioning sleeve for the energy adjustment is combined with a control sleeve, which is movable in relation to the at least one passage opening of the pre-chamber such that the at least one passage opening of the pre-chamber is released or closed by the control sleeve depending on the pressure in the at least one main combustion chamber.

13. The fuel-powered setting device as claimed in claim 1, wherein a flow cross section of at least one overflow opening between the pre-chamber and the at least one main combustion chamber is variable for the energy adjustment by the control device.

14. A method for operating a fuel-powered setting device for driving securing elements into a substrate, the fuel-powered setting device comprising at least one main combustion chamber for a fuel; a drive piston that can be driven out of the main combustion chamber in a setting direction by expandable gases; and a pre-chamber with which an ignition device is associated and in which a pressure acting on the main combustion chamber can be built up prior to a fuel-air mixture being ignited in said at least one main combustion chamber; wherein the setting device comprises a control device for energy adjustment, the method comprising adjusting the energy for operating the setting device.

15. The method as claimed in claim 14, wherein the fuel-powered setting device comprises at least one passage opening having a flow cross section, and the method comprises mechanically setting the flow cross section of the at least one passage opening for adjusting the energy.

16. The method as claimed in claim 14, wherein the fuel-powered setting device comprises at least one passage opening having a flow cross section, and the method comprises electrically setting the flow cross section of the passage opening by at least one operating element, which is connected to the control device, for adjusting the energy.

17. The method as claimed in claim 14, wherein the fuel-powered setting device comprises at least one passage opening having a flow cross section, and the method comprises turning on/off and/or regulating at least one valve device flow cross section of the at least one passage opening is for adjusting the energy.

18. The method as claimed in claim 14, wherein the fuel-powered setting device comprises a control sleeve having an opening mechanism, and the method comprises manually setting the opening mechanism of the control sleeve for adjusting the energy.

19. The method as claimed in claim 14, wherein the control device has a control pressure surface having an effective size, and the method comprises changing the effective size of the control pressure surface.

20. A device comprising a control device for adjusting energy, a positioning sleeve, a pre-chamber cylinder, a control sleeve, and/or a valve device for a fuel-powered setting device.

* * * * *